US005129818A

United States Patent [19]

Balsiger

[11] Patent Number: 5,129,818

[45] Date of Patent: Jul. 14, 1992

[54] METHOD OF FEEDING BACK EXHAUST GASES IN OIL AND GAS BURNERS

[76] Inventor: Benno Balsiger, Via al Mulino, CH-6814 Cadempino, Switzerland

[21] Appl. No.: 582,757

[22] Filed: Sep. 14, 1990

[51] Int. Cl.[5] ..... F23C 9/06; F23D 14/22

[52] U.S. Cl. ..... 431/4; 431/186; 431/187; 431/115

[58] Field of Search ..... 431/8, 9, 10, 4, 181, 431/182, 183, 12, 186, 189, 187, 188, 350, 353

[56] References Cited

U.S. PATENT DOCUMENTS 3,868,211 2/1975 Haye et al. ..... 431/115
4,331,638 5/1982 Michelfelder ..... 431/4 X
4,410,467 10/1983 Wentworth, Jr. ..... 431/4 X

FOREIGN PATENT DOCUMENTS 0022134 2/1977 Japan ..... 431/116

*Primary Examiner*—Carl D. Price
*Attorney, Agent, or Firm*—Lorusso & Loud

[57] ABSTRACT

The formation of nitrogen oxides during the operation of burners for solid, liquid, and gaseous fuels is reduced by means of an exhaust gas feed-back system. The exhaust gases are injected into a combustion chamber through openings provided in the region of stabilizer via a flame pipe and, by choice, also around the flame pipe. Preferably, the combustion air as well as the exhaust gases are activated by an active aerosol. The exhaust gas feed-back is effected by means of a longitudinally slidable adaptor pipe and an adaptor pipe shoulder enclosing the flame pipe at least partly. The regulation of the exhaust gas streams is achieved by displacing the adaptor pipe and the adaptor pipe shoulder.

18 Claims, 2 Drawing Sheets

METHOD OF FEEDING BACK EXHAUST GASES IN OIL AND GAS BURNERS

BACKGROUND OF THE INVENTION

1. Field of the Invention

The present invention relates to a method for reudcing formation of nitrogen oxides during operation of burners for solid, liquid, and gaseous fuels, the fuel being injected into a combustion chamber through a fuel pipe, and combustion air being supplied to the combusion chamber around the fuel pipe and around a fuel nozzle at the end of the fuel pipe through a combustion air pipe that extends into in a flame pipe in the region of the fuel nozzle, with which method the exhaust gases are led through an exhaust conduit and a part of the exhaust gases is supplied from the exhaust conduit to the combustion chamber. Furthermore, the invention relates to a corresponding apparatus.

2. Description of the Prior Art

An increasing interest in the protection of the enviroment leads to a continuous tightening of requlations regarding the emission of pollustants from oil and gas burners. Particular attention is directed to the emission of nitrogen oxides ($NO_x$). These contribute, inter alia, to the formation of acid rain and ozone. For example, primarily nitric oxide (NO) is responsible for the formation of ozone. The emission of nitrogen oxides is directly correlated to the height of the flame temperature. At elevated temperatures above 1200°, the air components nitrogen and oxygen react to $NO_x$ according to the so-called Zeldovich mechanism.

Based on this knowledge, exhaust gas feed-back systems are used to reduce pollutants. By doing so, on the one hand, and cooling of the flame is achieved, and, on the other hand, the partial pressure of oxygen is minimized by admixing inert exhaust gas, this partial pressure of oxygen being a prerequisite for the formation of $NO_x$.

In commercially available burners, fuel is injected into the combustion chamber through a central aperture of a disk shaped stabilizer that operates as a baffle element and is also referred to as baffle disk. Combustion air is supplied before the stabilizer through a combustion air pipe around the the fuel supply. In the region of the stabilizer, this combustion air pipe extends into a flame pipe. The admixture of exhaust gas takes place behind the stabilizer—as seen from the fuel supply—by means of an adaptor that encompasses the combustion air supply in a collar-like manner. In order to improve effectiveness, the combustion chamber is often divided into complicated combustion zones which are separated by means of microprocessor controlled shutter mechanisms. Consequently, the present burners must be replaced by complicated and expensive burners when exhaust gas feed-back systems are installed. In this way, not only the changing over to a new system, but also its maintenance becomes complicated and expensive.

SUMMARY OF THE INVENTION

It is the object of the invention to provide a method and a corresponding apparatus by means of which the emission of nitrogen oxides can effectively be reduced in most of the known gas and oil burners by using simple means.

According to the method of the present invention the foregoing is accomplished by a system in which the exhaust gases are led into the combustion chamber at least partly through openings prrovided in the combustion air pipe and/or the flame pipe. The apparatus according to the present invention is characterized in that an adaptor housing, an adaptor pipe and an adaptor shoulder at least partly encompass the flame pipe, and is characterized further in that the combustion air pipe and/or the flame pipe is provided with openings through which the exhaust gases may be let into the flame pipe.

The movable, particularly slidable adaptor pipe combined with the inlet openings in the flame pipe makes the alteration of exhaust gas streams within and surrounding the flame pipe possible in a very simple manner.

Adding an activator containing no heavy-metals makes a further reduction of the remaining pollutants also possible.

By way of example, the invention will be explained in more detail in the following.

BRIEFE DESCRIPTION OF THE DRAWINGS

In the drawings

DESCRIPTION OF THE PREFERRED EMBODIMENT

Figure 1:
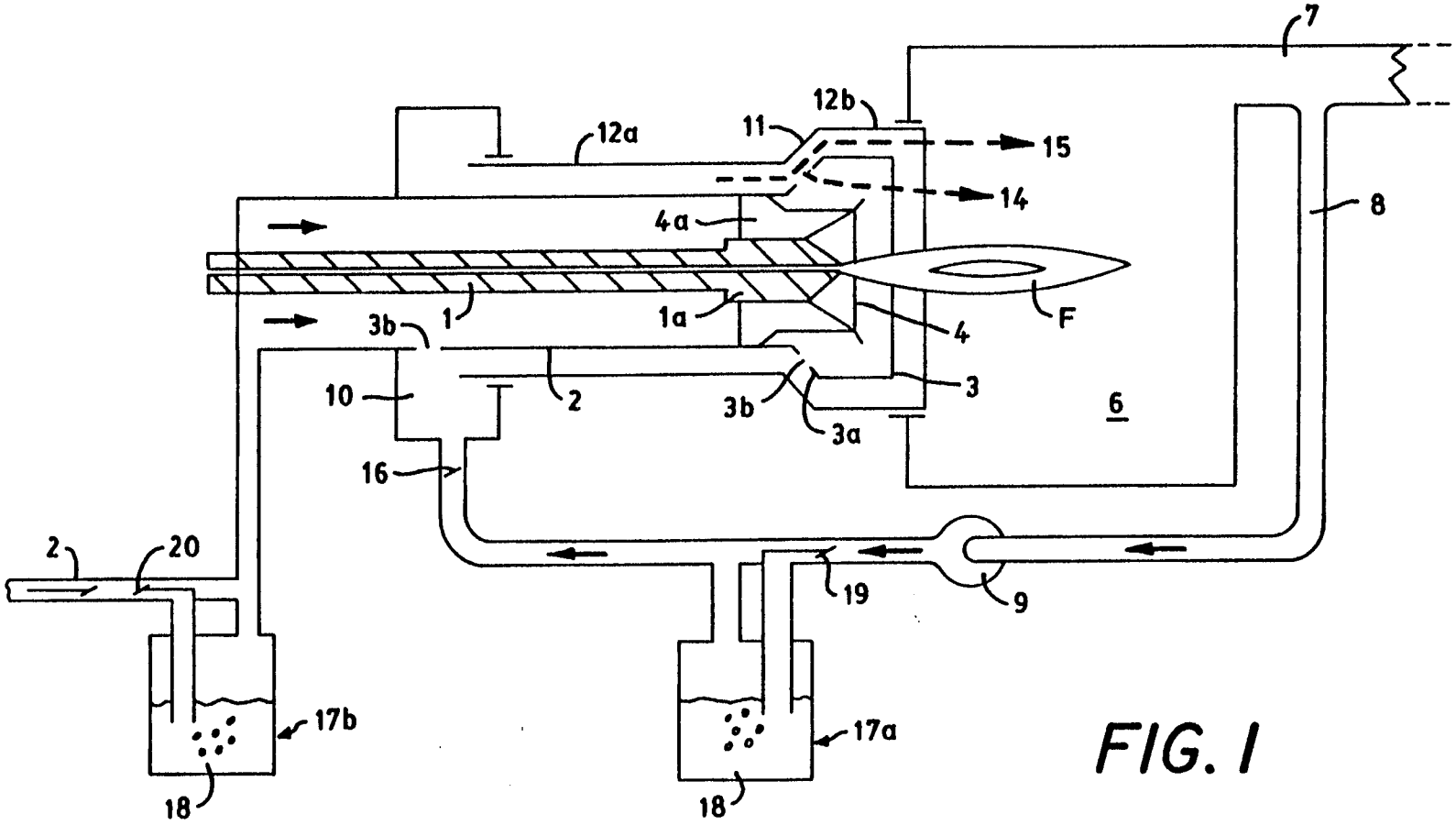
FIG. 1 shows a diagrammatic representation of a burner equipped with an exhaust gas feed-back system according to the invention.

FIG. 1 shows a diagrammatic representation of a burner for solid, liquid and gaseous fuels with an exhaust gas feed-back system according to the invention. Fuel is injected into a combustion chamber 6 through a fuel pipe 1 and by means of a fuel nozzle 1*a*. thus, a flame F is created. A generally circular disk 4 is connected to the fuel nozzle 1*a* by means of flanges 4*a*. The disk 4 acts as a stabilizer for the flame f a cumbustion air pipe 2 extends into a flame pipe 3 which comprises a conically shaped shoulder 3*a* near a stabilizer disk 4. The exhaust gases are discharged into a chimeny, not shown in the drawings. An exhaust gas feed-back channel 8 leads from an exhaust conduit 7 to an adaptor housing 10. In order to achieve a better feed-back of the exhaust gas, an exhaust blower is provided in the exhaust gas feed-back channel 8. Furthermore, the exhaust gas stream can be controlled by menas of a valve 16. An adaptor pipe portion 12*a* encompassing the combustion air pipe 2 comes out of the adaptor housing 10, the adaptor pipe portion 12*a* —via a conically rising adaptor shoulder 11—extending into an adaptor pipe portion 12*b* having a larger diameter and encompassing the flame pipe 3. The adaptor pipe 12*a*, 12*b* is supported at the adaptor housing 10 and the entrance point into the combustion chamber 6 in a longitudinally slidable manner. The shoulder 3*a* of the flame pipe 3 is provided with annularly arranged openings 3, the function of which will be explained in the following. The openings 3*b* may additionally be provided in the combustion air pipe 2 in the region of the adaptor housing 10 or the adaptor pipe portion 12*a*. Also, the shoulders 11 of the adaptor pipe 12*a*, 12*b* and of the flame pipe 3,3*a* or the combustion air pipe 2 can be arranged in front of the stabilizer disk 4 or, if no stabilizer is used, in front of the orifice of the fuel nozzle 1*a*.

Fuel is injected through the fuel pipe 1 into the combustion chamber 6. At the same time, combustion air is caused to enter the combustion chamber 6 through the combustion air pipe 2. The exhaust gases created during the combustion process air guided to the chimney through the exhaust conduit 7. A portion of the exhaust gases—with full load usually about 20%—is directed back into the adaptor housing 10 via the exhaust gas feed-back channel 8. Returning the exhaust gases is supported by means of the exhaust blower 9. A portion of the exhaust gases 15 flows through the ring space created between the flame pipe 3 and the adaptor pipe 12*a*, 12*b*, and the other portion passes through the openings 3*b* of the shoulder 3*a* of the flame pipe 3. The openings 3*b* are arranged so that exhaust gas portion streaming through them enters the prederrent combustion chamber 6 around the stabilizer disk 4. The exhaust gases are led into the combustion chamber 6 through the openings 3*b* provided in at least one of the combustion air pipe 2 and the flame pipe 3.

This kind of dividing provides various advantages as compared to conventional exhaust gas feed-back systems. On the one side, using simple means, an exhaust gas feed-back system reducing nitrogen oxides can be installed afterwards, too. Owing to the slidability of the adaptor pipe 12*a*, 12*b* and the adaptor shoulder 11 different types of burners, e.g. flame inverse or triple-flue boilers, can be later equipped with the same simple adaptor system. If—as described in the embodiment—a burner is used the flame pipe of which comprises a conical shoulder, in most cases, a conventional flame pipe of larger diameter can be used as adaptor pipe 12*a*, 12*b* and adaptor shoulder 11. This flame pipe is slided over the combustion air pipe 2 and the flame pipe 3 and is provided with an adaptor housing 10 that is connected to the exhaust gas feed-back channel 8, and, in this way, makes the provision of the adaptor system on existing burners possible at particular low cost.

Figure 2:
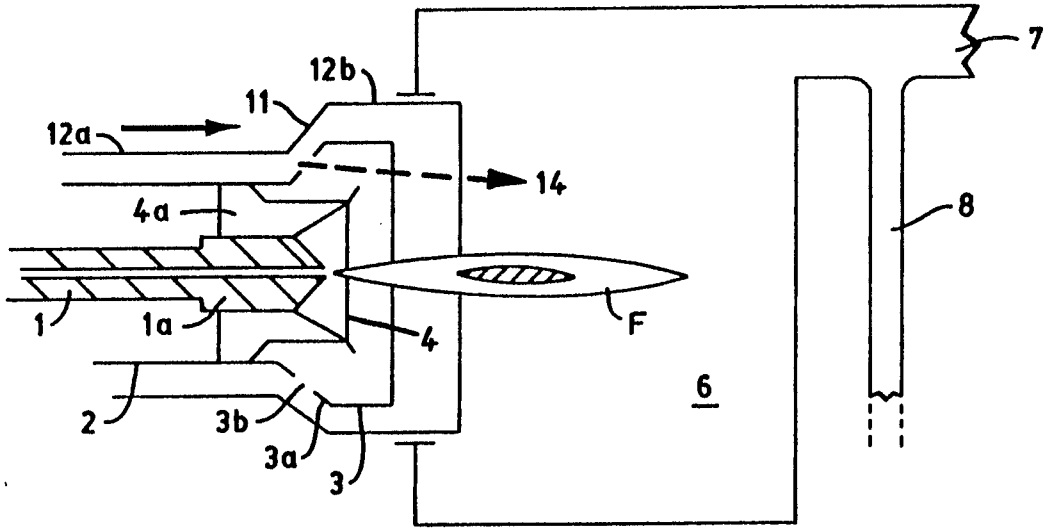
FIG. 2 shows a detailed representation of the adaptor pipe in a extreme position.

Depending on the burner, the ratio of the exhaust gas portion 1j streaming into the flame pipe 3 to the exhaust gas portion 15 flowing around the flame pipe 3 must be varied in order to achieve an optimum result. Consequently, it is advantageous to support the adaptor pipe in a longitudinally slidable manner so that the gap between the shoulders 3*a* and 11 can be varied. If this gap is totally closed the exhaust gas does not reach the ring-shaped space between the flame pipe 3 and the adaptor pipe 12*a*, 12*b*, but the region around the stabilizer disk 4 only. As shown in FIG. 2, the gap is substantially closed.

A further embodiment may also comprise slidable or rotating (e.g. annularly shaped) regulating shutters by means of which the width of the openings 3*b* of the flame pipe shoulder 3*a* can be varied and which may possibly operate as additional regulating means.

As the combustion is slowed down and the flame temperature is decreased in the exhaust gas feed-back system described above, the emission of soot and carbon monoxide is increased. To avoid this, it is advisable in most cases to provide an additional activator, such as an aqueous electrolyte 18. With such an activator 18, a small portion of the combustion air is passed by active 20 through aerosol generator 17*b* having therein the aqueous electrolyte 18, and supplied to the combustion air and/or to the exhaust gases in form of an aerosol. The electrolyte solution 18 comprises alkali and/or alkaline earth salts and possibly 2 to 12%, preferably about 5, of methyl alcohol. thus, the combustion air may be activated by an aqueous aerosol which contains at least one substance selected from the group consisting of alkali salts, alkaline earth salts and methyl alcohol. The air or exhaust gas activated in this manner is provided with aerosol particles that evaporate in the combustion chamber and dissociate into ions. The ions take part in the oxidation process, accelerate the ignition and signficantly decrease the formation of soot, CO and other pollutants. At this point, it is pointed out that such an activator does not contain heavy-metals.

Figure 3:
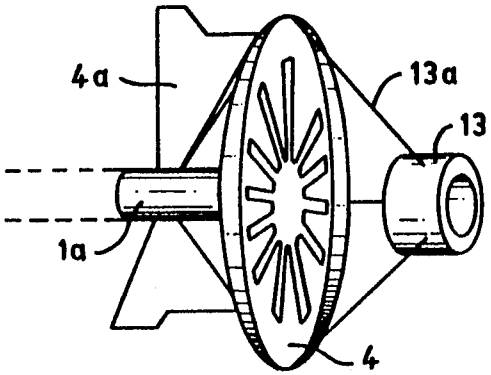
FIG. 3 shows a stabilizer with a re-circulation ring.

It is advatageous to activate the feed-back exhaust gas in the same manner, i.e., by a small portion of the exhaust gas passed by a valve 19 through an aerosol generator 17*a* (FIG. 1) having therein the aqueous electrolyte 18. Itt is important to obtain a mixture of combustion air, exhaust gas and activator particles that is as homogeneous as possible. In order to enhance the homogenization of the mixture. a re-circulation ring 13 may be arranged at the stabilize disk 4 in front of the fuel nozzle 1*a* as shown in FIG. 3. The re-circulation ring 13 may be mounted to stabilizer disk 4 by means of a mounting support 13*a*. The diameter of the re-criculation ring is less than half the diameter of the stabilizer disk 4.

By the combustion with the activator 18, it is—in contrast to conventional methods—possible to operate also large-scale plants under full load, and thus, to keep the emission of pollutants within acceptable limits.

What is claimed is:

1. A method for reducing formation of nitrogen oxides during operation of burners for a fuel selected from the group consisting of solid, liquid, and gaseous fuels, the fuel being injected into a combustion chamber through a fuel pipe, and combustion air being supplied to the combustion chamber around the fel pipe and around a fuel nozzle at the end of the fuel pipe through a combustion air pipe that extends into a flame pipe in the region of the fuel nozzle, exhaust gases from the combustion chamber being led through an exhaust conduit and a part of the exhaust gases being supplied from the exhaust conduit to the combustion chamber, the exhaust gases being led into the combustion chamber through openings provided in at least one of the combustion air pipe and the frame pipe, characterized in that the combustion air is activated by an aqueous aerosol which contains at least one substance selected from the group consisting of alkali salts and alkaline earth salts and methyl alcohol.

2. The method in accordance with claim 1 wherein said aqueous aerosol contains 2% to 12% of said methyl alcohol.

3. The method in accordance with claim 1 wherein said aqueous aerosol contains about 5% of said methyl alcohol.

4. A method for reducing the formation of nitrogen oxides during operations of burners for a fuel selected from the group consisting of solid, liquid, and gaseous fuels, the fuel being injected into a combustion chamber through a fuel pipe, and combustion air being supplied to the combustion chamber around the fuel pipe and around a fuel nozzle at the end of the fuel pipe through a combustion air pipe that extends into a flame pipe in the region of the fuel nozzle, exhaust gases from the combustion chamber being led through an exhaust conduit and a part of the exhaust gases being supplied from the exhaust conduit to the combustion chamber, the exhaust gases being led into the combustion chamber through openings provided in at least one of the combustion air pipe and the flame pipe, characterized in that the exhaust gases led back are activated by an aqueous aerosol which contains at least one substance selected from the group consisting of alkali salts and alkaline earth sales and methyl alcohol.

5. The method in accordance with claim 4 wherein said aqueous aerosol contains 2% to 12% of said methyl alcohol.

6. The method in accordance with claim 4 wherein said aqueous aerosol contains about 5% of said methyl alcohol.

7. An apparatus for feeding back exhaust gases with burners for a fuel selected from the group consisting of solid, liquid and gaseous fuels, the apparatus comprising a burner that comprises aa fuel pipe with a fuel nozzle at an end thereof, a combustion air pipe, and a flame pipe, the apparatus further comprising a combustion chamber to which an exhaust conduit is connected, and an exhaust gas feed-back channel connected to the exhaust conduit and leading to an adaptor housing, characterized in that an adaptor pipe extending from said adaptor housing and an adaptor shoulder at least partly encompasses the flame pipe, and in that at least one of the combustion air pipe and the flame pipe, is provided with openings through which the exhaust gases enter the flame pipe, and further characterized in that the burner is connected to a device that generates an aqueous aerosol containing at least one substance selected from the group consisting of alkali salts, and alkaline earth salts, and methyl alcohol, in order to activate combustion air.

8. The apparatus according to claim 7, characterized in that the adaptor pipe is a pipe with a larger diameter at an entrance point into the combustion chamber than that of the flame pipe of the burner.

9. The apparatus according to claim 7, characterized in that the adaptor pipe encompassing the flame pipe leads into the combustion chamber, so that a ring space leading into the combustion chamber is formed through which a portion of the exhaust gases fed back can be injected into the combustion chamber.

10. The apparatus according to claim 9, characterized in that the flame pipe and the adaptor pipe are each provided with a shoulder in the region of the openings, so that a gap is formed between the two shoulders, and in that the adaptor pipe is supported in a longitudinally movable manner so that the gap width, and thus the ratio of the portions of the exhaust gases that enter the openings of the flame pipe, can be varied by moving the adaptor pipe in its longitudinal direction.

11. The apparatus according to claim 7, characterized in that a stabilizer and a re-circulation ring behind said stabilizer are arranged in the region of the fuel nozzle.

12. The apparatus according to claim 11, characterized in that the diameter of the re-circulation ring is less than half the diameter of the stabilizer.

13. An apparatus for feeding back exhaust gases with burners for a fuel selected from the group consisting of solid, liquid and gaseous fuels, said apparatus comprising a burner that comprises a fuel pipe with a fuel nozzle at an end thereof, a combustion air pipe, and a flame pipe, the apparatus further comprising a combustion chamber to which an exhaust conduit is connected, and an exhaust gas feed-back channel connected to the exhaust conduit and leading to an adaptor housing, characterized in that an adaptor pipe extending from said adaptor housing and an adaptor shoulder at least partly encompasses the flame pipe, and in that at least one of the combustion air pipe and the flame pipe, is provided with openings through which the exhaust gases enter the flame pipe, and further characterized in that the burner is connected to a device that generates an aqueous aerosol containing at least one substance selected form the group consisting of alkali salts, and alkali earth salts, and methyl alcohol, in order to activate the exhaust gases fed back.

14. The apparatus according to claim 13, characterized in that the adaptor pipe is a pipe with a larger diameter at an entrance point into the combustion chaamber than that of the flame pipe of the burner.

15. The apparatus according to claim 13, characterized in that the adaptor pipe encompassing the flame pipe leads into the combustion chamber, so that a ring space leading into the combustion chamber is formed through which a portion of the exhaust gases fed back can be injected into the combustion chamber.

16. The apparatus according to claim 15, characterized in that the flame pipe and the adaptor pipe are each provided with a shoulder in the region of the openings, so that a gap is formed between the two shoulders, and in that the adaptor pipe is supported in a longitudinally movable manner so that the gap width, and the thus the ratio of the portions of the exhaust gases that enter the openigns of the flame pipe, can be varied by moving the adaptor pipe in its longitudinal direction.

17. The apparatus according to claim 13, characterized in that a stabilizer and a recirculation ring behind said stabilizer are arranged in the region of the fuel nozzle.

18. The apparatus according to claim 17, characterized in that the diameter of the recirculation ring is less than half the diameter of the stabilizer.

* * * * *